United States Patent [19]

Murphy et al.

[11] Patent Number: 4,463,835

[45] Date of Patent: Aug. 7, 1984

[54] SLIDE BEARING ATTACHMENT FOR U-SECTION TYPE UNIT BRAKE BEAM GUIDE LUGS

[75] Inventors: Richard F. Murphy, Batavia; Michael K. Murphy, Aurora, both of Ill.

[73] Assignee: Holland Co., Aurora, Ill.

[21] Appl. No.: 416,849

[22] Filed: Sep. 13, 1982

[51] Int. Cl.[3] ..... B61H 13/00

[52] U.S. Cl. ..... 188/52; 188/209; 188/233.3

[58] Field of Search ..... 188/52, 53, 54, 55, 188/195, 197, 205 R, 207, 209, 214, 215, 219.1, 49, 212, 213, 233.3, 226.1, 233.7, 50, 51; 308/3 R, 3.5; 213/21, 61; 105/168, 182 R, 206 R

[56] References Cited

U.S. PATENT DOCUMENTS

| | | | |
|---|---|---|---|
| 2,918,149 | 12/1959 | McClure et al. | 188/197 |
| 3,207,271 | 9/1965 | Polanin et al. | 188/195 |
| 3,266,601 | 8/1966 | Taylor | 188/195 X |
| 3,386,533 | 6/1968 | Taylor et al. | 188/52 |
| 4,211,311 | 7/1980 | McMullen | 188/52 X |

OTHER PUBLICATIONS

Page 617, Car & Locomotive Cyclopedia, 1980, Pub. by Simmons-Boardman Pub. Corp.

*Primary Examiner*—Douglas C. Butler

*Attorney, Agent, or Firm*—McWilliams, Mann, Zummer and Sweeney

[57] ABSTRACT

A slide bearing for attachment to U-section formed sheet metal type guide lugs of unit brake beams for mounting the unit brake beams equipped with such guide lugs in the railroad car truck side frame unit brake beam guide brackets, preferably in place of the conventional spring steel wear plate now generally in use comprising a one piece box like body, preferably formed from a polymeric material, such as UHMW polyethylene, of dry self lubricating characteristics that is rectilinear and planar in outline and of U-shaped transverse cross-sectional configuration defining a web portion and spaced apart side walls shaped and proportioned for substantially complemental but slidable seating in the side frame guide bracket in which the guide lug is to be mounted, with the side walls being closed at their end edges by integral end walls and with the inner surfacing of the side walls and the bearing body being formed to closely receive the brake beam guide lug, and with the respective body side walls each recessing in opposed relation a truncated washer. The washers have their center portions welded to the guide lug side walls to secure the bearing to the guide lug, and when the brake beam is mounted in its operating position in the side frame guide brackets adapted to hold same, the guide lug bearings dispose the brake beam guide lugs to which they are applied in substantially coplanar alignment with the desired brake beam movement radially of the axle wheel to be braked, on actuation of the brakes.

20 Claims, 15 Drawing Figures

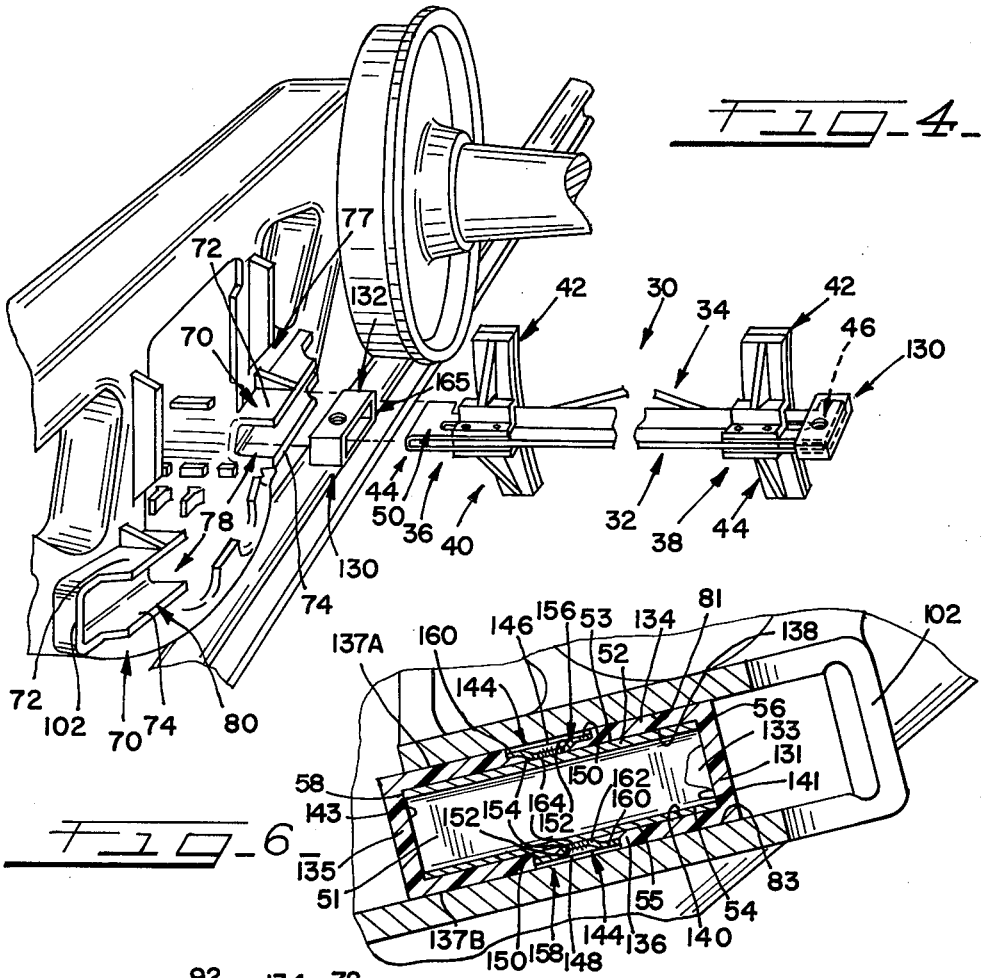
FIG. 4
FIG. 6
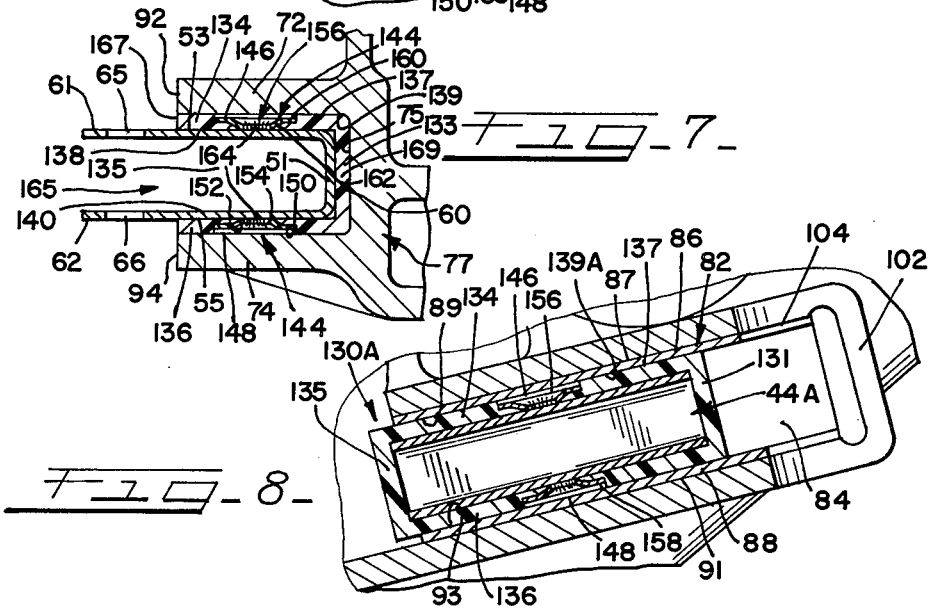
FIG. 7
FIG. 8

FIG. 12
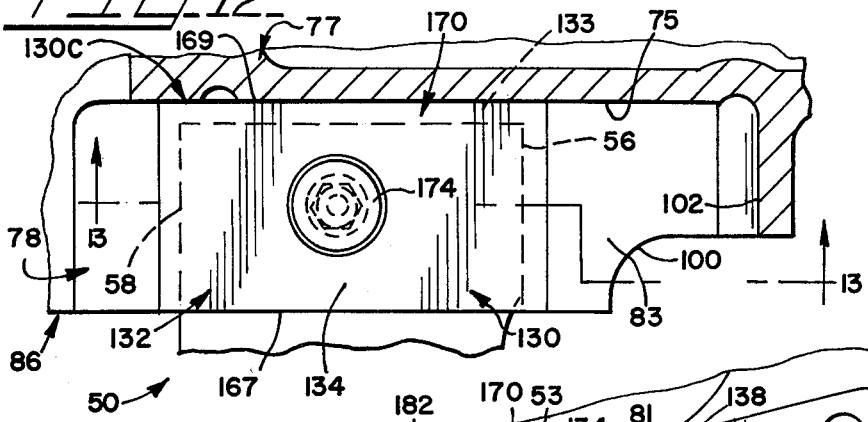
FIG. 13
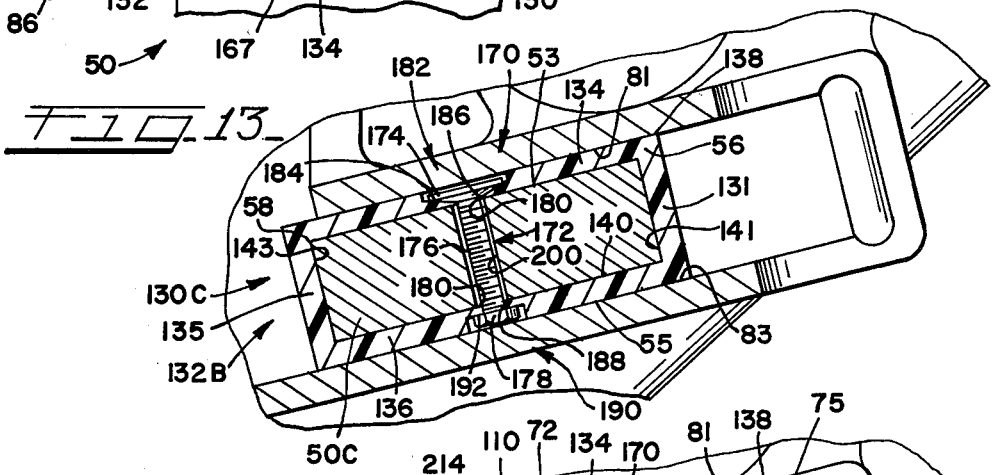
FIG. 15
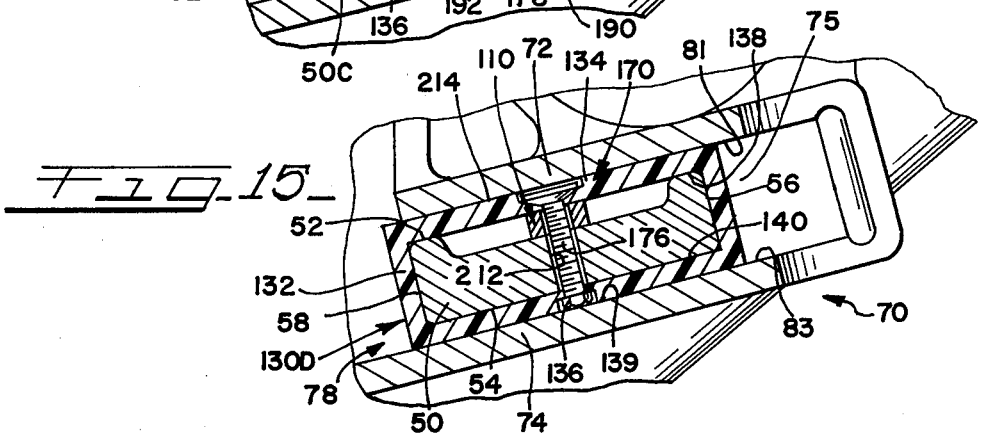
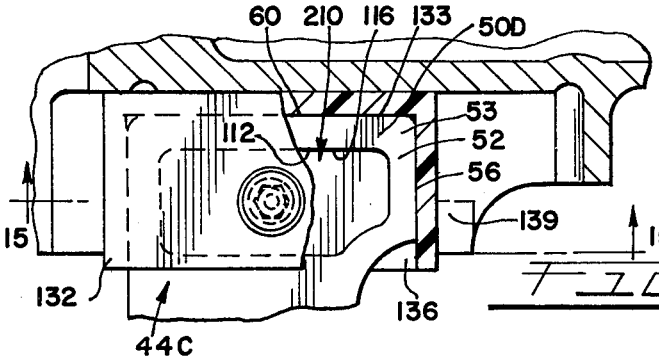
FIG. 14

SLIDE BEARING ATTACHMENT FOR U-SECTION TYPE UNIT BRAKE BEAM GUIDE LUGS

This invention relates to a slide bearing for operably mounting unit brake beams of railroad car trucks, and more particularly, to a slide bearing adapted for application to the guide lugs of unit brake beams for slidably mounting the brake beam in the truck side frame guide brackets, in the operating relation of the brake beam relative to the axle wheels to be braked by the brake shoes carried by same.

Unit brake beams conventionally include at their ends extensions in the form of a guide lug forming each extension for mounting the brake beam adjacent the wheels of the truck axle to be braked by the particular brake beam involved, in guide brackets (AAR standard S-366-79) that are ordinarily formed as an integral part of each truck side frame that is of the type to be equipped with unit brake beams, on the in-board side of same and to either side of the side frame spring seat on which the bolster supporting spring groups rest. In any given four wheel truck, for instance, that is to mount unit brake beams, the truck side frames define on their in-board sides a first opposed pair of such guide brackets on one side of the bolster and a second opposed pair of such guide brackets on the other side of the bolster. The guide brackets on either side of the truck are oppositely and upwardly inclined in the indicated paired relationship, and the respective pairs of guide brackets are located to lie on a radius of a truck axle to be braked by the application of the unit brake beam thereto that is mounted in a given pair of opposed side frame unit brake beam guide brackets. AAR standards call for these brackets to be inclined to the horizontal at an angle of 14 degrees for 40, 50, 70, and 90–100 ton cars, and at an angle of 16 degrees for 125 ton cars.

In use, to mount the unit brake beam from the side frame guide brackets that are to support same, conventionally each guide bracket has applied to same a wear plate (AAR standard S-367-78) formed from spring steel in a shape to overlie the upper and lower walls of the bracket in which the wear plate is mounted, and be snap fit applied to such bracket. Conventional practice involving the unit brake beams in operative relation on the truck is to insert the brake beam guide lugs in an opposed set of such wear plate equipped guide brackets, with the unit brake beam shoes connected at the axle wheel to be braked. For the common two axle four wheel type truck, one brake beam is mounted in such guide brackets on one side of the truck bolster and the other brake beam is similarly mounted on the other side of the bolster, with the set of brake beams involved being suitably interconnected and actuated by suitable power means well known to the art to move the brake beams upwardly and away from the truck bolster to apply the brake shoes carried thereby against the truck wheels, as is well known to the art, and accommodate return of the brake beams to their retracted positions, either under vibration and gravity, or by the power means employed, or both, depending on the type of equipment involved.

It is an established fact in the railroad field that undue and uneven wear of brake shoes, and even the unit beams themselves, is a costly and long standing maintenance problem for the railroads. One major railroad has advised that it has to spend something on the order of 12 and ½ million dollars each year to replace brake shoes in unit brake beams due to uneven wear.

The basic problems involved and a successful solution therefor are the subject of the copending application of Richard F. Murphy, Ser. No. 376,823, filed May 12, 1982 (and assigned to the same assignee of the present application), which application reveals that the manner of conventionally mounting unit beams for operative movement in the indicated steel wear plate equipped guide brackets is a major cause of the undue and uneven wear problem. The steel wear plates only loosely receive the unit brake beam guide lugs, especially when worn, and since the wear plates are the only means provided to guide the movement of the unit brake beam involved for any given pair of brake beam guide brackets, the result is that the brake beams sag, brake shoes side downwardly, with the result that the upper ends of the brake beam shoes are subjected to excessive braking wear, and even tend to drag at their upper ends on the axle wheels they are to cooperate with, in the retracted positions of the brake beams. The looseness of the brake beam guide lug mounting in the guide bracket conventional wear plates is a necessity, however, if the brake beams are to move with any degree of freedom relative to their mounting brackets, as otherwise too much energy would be lost in the braking effort due to the binding and frictional engagement that the brake beam guide lugs are subject to within their mounting wear plates. Furthermore, as most brake equipment does not provide for powered return or retraction of the brakes, gravity and train movement vibration along the track rails is relied upon to return the brake beams to retracted relation. Thus, the loose or sloppy fit indicated is an absolute necessity for the brake beams to achieve return to something reasonably approaching their retracted positions, as otherwise the brake beams would fail to return to their retracted positions so as to be adequately spaced from the axle wheels when the brakes are not operating.

The result is that the wear of unit brake beam brake shoes is commonly uneven, sometimes to the point where the upper portion of the brake beam head or heads also wears, which requires replacement of the unit brake beam itself. The sloppy fit of the unit brake beam guide lugs within their wear plate mountings, and the eccentric weight action thereon that is presented by the weight of the brake beam heads and shoes, results in cocking of the guide lugs within their wear plate mounts, which in addition to the steel on steel static and sliding friction that must be overcome with regard to the engaging metallic surfaces that are involved, such metallic surfaces are subject to corrosion, and foreign material build ups, which result in undesirable loss of braking pressure increased brake application time, and unreliable and often partial brake beam retraction, in addition to the uneven wear problem (that is frequently caused by poor retraction).

A further problem is that the truck side frame guide brackets themselves are subject to considerable wear due to the constant rubbing of the spring steel wear plate thereagainst in service, as the spring steel from which such wear plates are formed is harder than the Grade B or C steel from which the truck side frames are conventionally formed.

A principal object of the present invention is to provide a novel mounting arrangement for the guide lugs of unit brake beams that permits replacement of the conventional unsatisfactory but widely used spring steel wear plate with a polymeric slide bearing that holds the brake beam and is guided by the guide brackets throughout the brake beam stroke for flush application of the brake shoes to the wheels, while providing for minimal power loss due to the actuation of the brakes and minimized brake application time requirement as well as full and easy return of the brake beams to their retracted positions.

Another principal object of the invention is to provide a simplified slider bearing device that permits elimination of the troublesome spring steel wear plate in favor of a polymeric slide bearing of flat box configuration that is received on and about the brake beam guide lug for slidably mounting same in its brake beam guide bracket, which bearing has its external surfacing defined by polymeric surfaces that are essentially wear free, fully corrosion resistant, and that are of dry self lubricating characteristics, which when the bearing device is applied to the side frame guide bracket that is to mount the end of the brake beam bearing the guide lug in question, holds the brake beam guide lug it slidably mounts so that the brake beam and the guide lugs at either end of same are held in substantially coplanar relation with the axle of radius of the side frame guide brackets are formed on, so that the brake beams move in a truly free manner on brake application and release, with the brake shoes being flush applied to the wheel rim or tread surfaces they are to frictionally engage during the course of the braking stroke.

Another important object of the invention is to provide a slide bearing of the type indicated that is proportioned to closely receive the unit brake beam guide lug it is to be applied to, for adapting the brake beam to be slidably mounted by its guide lugs for free sliding movement in its side frame guide brackets for full flush application of the brake beam brake shoes to the axle wheel they are to engage.

Yet another important object of the invention is to provide a slide bearing arrangement of the type indicated formed from a polymeric material low coefficient of friction characteristics for antifriction slide mounting of the brake beam guide lugs in their truck side frame guide brackets that is specifically adapted for application to a common type of brake beam guide lug arrangement in which the lug is of sheet metal U-shaped section defining a web portion that faces the respective side frames (of the truck in which the brake beam is mounted) and upper and lower side flanges or side walls projecting from said web portion for connection to the brake beam main beam, in which the slide bearing closely receives the guide lug and is connected to either side wall or flange thereof to permanently to secure these components together.

Still other objects of the invention are to provide a slide bearing arrangement of the type indicated that requires no modification of the truck side frames or unit brake beams in use, that will provide for substantially uniform wear on the brake shoes and avoid the brake head wear problem in practice, that is economical of manufacture, convenient to apply both to the brake beam guide lugs and the side frame guide brackets, and that is essentially wear free in use.

In accordance with the invention, a slide bearing for slidably mounting the guide lugs of unit brake beams is provided, for application to the truck side frame unit brake beam guide brackets, preferably in place of the troublesome spring steel wear plates now in general use. The bearing of the instant application is specifically arranged for application to unit brake beam guide lugs of the conventional well known formed sheet metal type in which the lug is of U-section with the lug web portion being the part of the lug that faces the truck side frame of the guide bracket which the lug is to be slidably mounted, and the lug upper and lower side walls or flanges project from the lug web portion and define spaced apart straps that are apertured for connection to the brake beam main beam. The bearing comprises a one piece body formed from an ultra high molecular weight polymer, but not necessarily, preferably polyethylene, of dry self lubricating characteristics that is of rectilinear outline and of flat box shaping having a channel shaped transverse cross-sectional configuration, defining a web portion that seats at the bottom of the side frame guide bracket, spaced apart side walls that slidably engage the guide bracket top and bottom walls, respectively, with the bearing web portion and side walls being shaped and proportioned for substantially complemental but sliding fit seating of the slide bearing and guide bracket, and the side walls being closed at their end edges by integral end walls, whereby a box like bearing body is defined and is open at its end opposing the bearing body web portion, to receive the guide lug. The bearing body is formed such that the inner surfacings of the bearing body web portion and side and end walls are disposed to closely receive the unit brake beam guide lug to be mounted in same, whereby the bearing and the guide lug are essentially in coplanar, squared relation, with each side wall of the bearing recess mounting a truncated metallic washer, with such washers thus being disposed to either side of the guide lug when the latter is received in the slide bearing for being made fast to the guide lug side walls or flanges.

When the brake beam having its indicated type guide lugs so equipped with the indicated slide bearings is mounted in its operative relation with respect to the truck side frame guide brackets that are to operatively mount same for movement toward and away from the axle wheels the brake beam is to cooperate with, the brake beam guide lugs are disposed in and maintained in substantial coplanar alignment with the desired brake beam movement path radially of the axle wheels to be braked (on actuation of the brakes). The outer surfacings of the bearing side walls are uncoated, and are fully corrosion resistant, and have a coefficient of friction with respect to steel of about 0.15, while the inner surfacings of the bearing body are formed to closely receive the guide lug, for slidably mounting same, antifriction style, within the side frame guide bracket that is to operatively mount the guide lug in question.

Other objects, uses, and advantages will become obvious or be apparent from a consideration of the following detailed description and the application drawings in which like reference numerals indicate like parts throughout the several views.

In the drawings:

FIG. 1 is a diagrammatic elevational view of the inboard side of a typical conventional four wheeled truck having unit brake beam equipment, with some parts being shown in phantom and other conventional parts being omitted as irrelevant, and with the bolster, axles, and wheels being shown in outline, the view illustrating, diagrammatically only, the conventional manner of slidably mounting the guide lugs of hangerless brake beams in the side frame guide brackets within the conventional spring steel wear plate with which each guide bracket is provided for this purpose, and the manner in which the brake shoes are supposed to be presented to the wheel treads for braking;

FIG. 4 is an exploded, fragmental, diagrammatic perspective view illustrating the general nature of the slide bearing arrangement of the present invention, its application to the brake beam guide lugs of the type indicated in FIG. 3, and the corresponding application of the slide bearings to the truck side frame guide brackets;

FIG. 6 is a fragmental sectional view taken substantially along line 6—6 of FIG. 5;

FIG. 7 is a fragmental cross-sectional view taken substantially along line 7—7 of FIG. 5;

FIG. 8 is a view similar to that of FIG. 5, but illustrating a modified embodiment;

Figure 5:
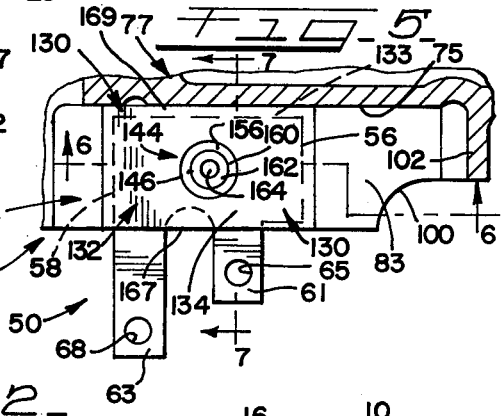
FIG. 5 is a view similar to that of FIG. 3, but with the slide bearing of this invention applied to the guide lug shown in FIG. 3 and the side frame guide bracket in replacement of the conventional spring steel wear plate.
Figure 10:
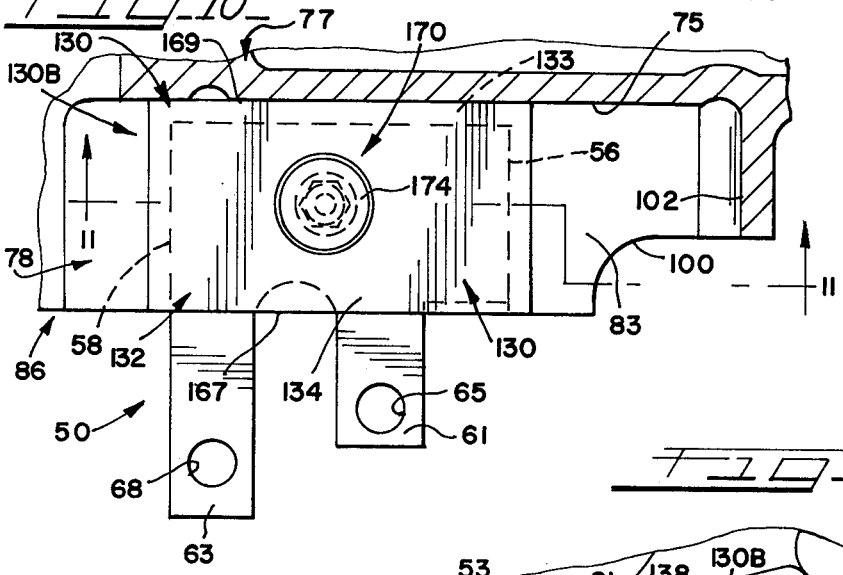
Figure 11:
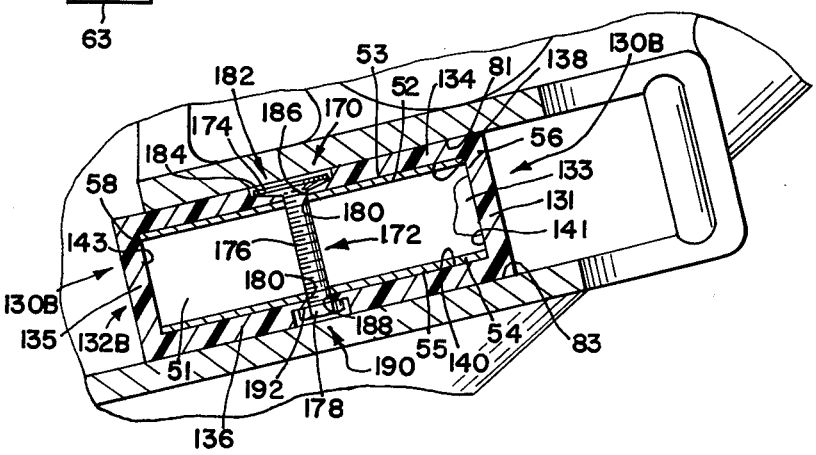

FIGS. 10 and 11 are similar to FIGS. 5 and 6, respectively, but illustrating further modified embodiments; and FIGS. 12, 13, 14 and 15 are similar to FIGS. 5 and 6, respectively and illustrate further embodiments.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
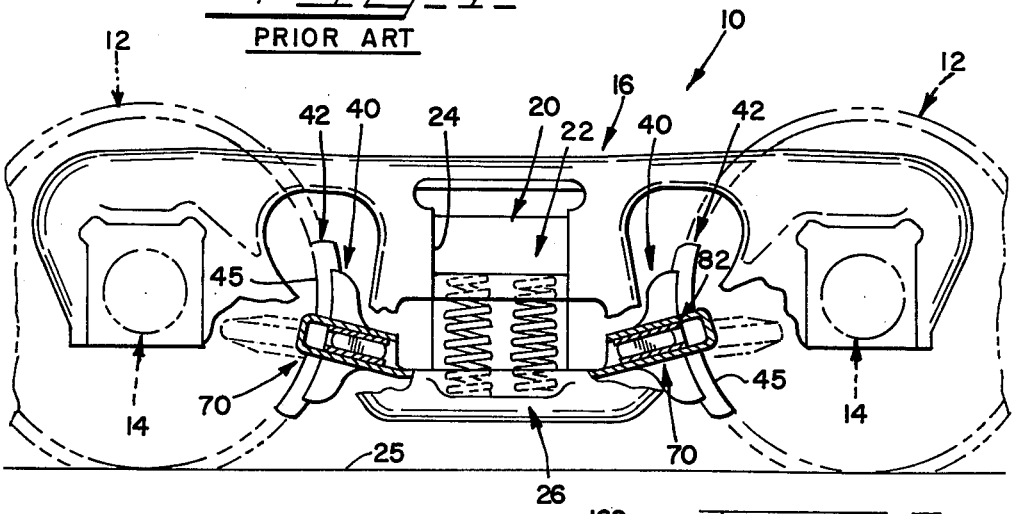
FIG. 1 PRIOR ART
Figure 3:
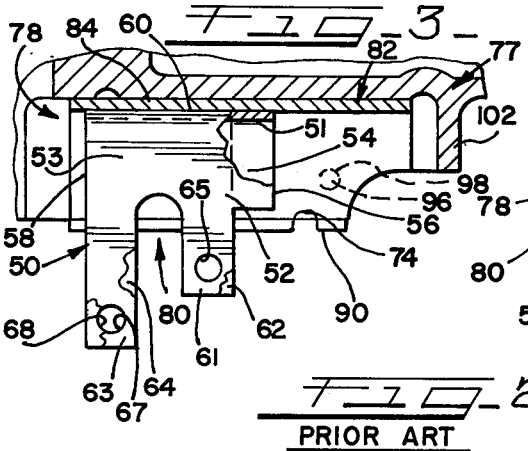
FIG. 3 is a fragmental cross-sectional view taken substantially along line 3—3 of FIG. 2, showing substantially in plan another form of conventional brake beam guide lug that is of the type to which the slide bearing of this application is specifically adapted for application.
Figure 2:
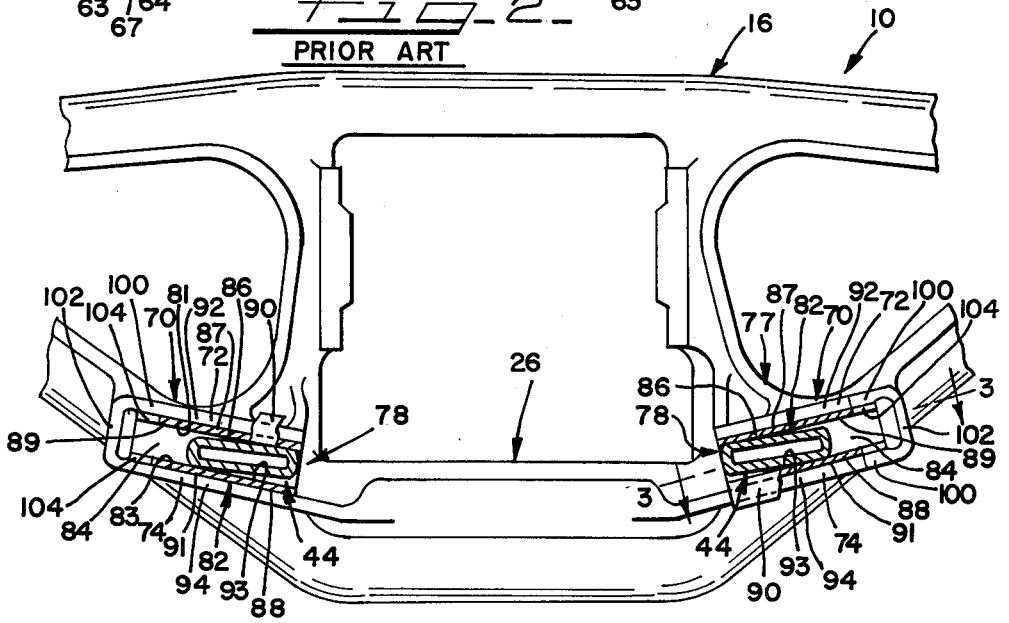
FIG. 2 PRIOR ART
FIG. 2 is an enlarged fragmental view of the in-board side of the truck frame shown in FIG. 1, better showing the conventional mounting arrangement of the unit brake beam guide lugs and the conventional truck side frame guide brackets and spring steel wear plates therefor, with this drawing Figure illustrating one of the major problems presented by this conventional arrangement.

FIGS. 1–3 are provided primarily to make clear the structural environment to which the invention is applicable. The invention, as indicated, is concerned with the mounting of unit brake beams that for purposes of the invention may in and of themselves be of any conventional type having the formed sheet metal type guide lug that is diagrammatically illustrated in FIG. 3, which represents the guide lug that the hangerless unit brake beam offered by Buffalo Brake Beam Company (of Buffalo, New York) is equipped with (see page 617 of the Car & Locomotive Cyclopedia for 1980, the disclosure of which is hereby incorporated herein by this reference). The arrangement of the truck, may, for example, follow the general arrangement illustrated in Taylor U.S. Pat. No. 3,266,601, with FIG. 1 of said Murphy application diagrammatically illustrating such a truck arrangement to make clear the nature of the conventional mounting arrangement of the unit brake beams and related parts, and that portion of the disclosure of said Murphy application is hereby incorporated herein by this reference.

Referring now more specifically to FIGS. 1–3 of the instant application, reference numeral 10 generally indicates a conventional railroad car truck that includes the usual wheels 12 mounted on the respective axles 14 with the ends of the axles being suitably journaled in the opposed truck side frames that are identical in construction, one of which is indicated by reference numeral 16. The usual truck bolster 20 extends between the truck side frames 16 and has its opposite ends mounted on the usual spring groups 22 (see FIG. 1), that are received in the side frame windows 24 and that are seated on the respective side frame spring seats 26 in the usual manner whereby the bolster 20 is isolated from the direct rail shock encountered by the truck wheels 12 that are directly transmitted to the truck side frame 16. As is customary, the truck wheels 12 ride on the usual rails 25, and two of such trucks are provided to support the conventional railroad car by the usual pivot connection to the bolster 20 at the bolster bowl (not shown), all as is well known in the art.

Conventional trucks 10 may be equipped with any suitable type of brake equipment of the unit brake type, the truck mounted package brake unit disclosed in said Taylor U.S. Pat. No. 3,266,601 being an example, and the disclosure of said Murphy application illustrating in FIGS. 1–4 thereof an example of such brake may be referred to for suggestions as to the general arrangement of the unit brake beams, the conventional manner of mounting same between the truck side frames for application to the truck wheel tread surfaces, and the power means for effecting the brake stroke including the brake levers and related and associated components. The invention is also equally applicable to the well known and older, more common, car body mounted braking system where hangerless brake beams are employed.

For purposes of the disclosure of the present application, the brake beam indicated at 30 in FIG. 4 diagrammatically represents in a fragmental perspective view showing the aforementioned Buffalo unit brake beam, the center portion of which is omitted in the showing of FIG. 4 to permit both end portions to be illustrated, with the brake beam 30 generally comprising the familiar main beam 32 having truss member 34 suitably connected to and between the respective ends 36 and 38 of same, the usual center strut that is interposed between the apex of the truss 34 and the mid portion of the main beam 32 that are omitted in the showing of FIG. 4, the usual familiar brake heads 40 that the main beam ends 36 and 38 that are equipped with the usual shoes 42 that are also shown in FIG. 1. In the showings of FIGS. 1 and 4 the brake heads 40 and their shoes 42 are indicated in largely block diagram form.

The brake beam 30 at its ends 36 and 38 includes the respective conventional formed sheet metal guide lugs 44 and 46 that are suitably secured thereto, as by employing suitable fasteners (not shown), such as rivets or the like. In the specific form illustrated in FIGS. 1–11, the guide lugs 44 and 46 are affixed to the main beam 32 of brake beam 30 by rivets (not shown).

The guide lugs 44 and 46 of beam 30 are identical, and are shaped so that either guide lug 44 or 46 may be applied to either end of the main beam 32. As indicated by the showing of FIG. 3, guide lugs 44 and 46 typically comprise a generally flat or planar metallic body 50 of U-shaped sheet metal construction defining web portion 51, upwardly facing side wall 52 having upper facing external surfacing 53, and downwardly facing side wall 54 having downwardly facing external surfacing 55, with these portions of the body 50 forming forwardly facing rectilinear side edging 56 that is of U-shaped configuration, rearwardly facing side edging 58 that is also of U-shaped configuration (see FIG. 4), and outwardly directed side edging 60 that is defined by web portion 51 and faces the truck side frame in the mounted relation of the brake beam 30. The guide lug side walls 52 and 54 of each are shaped to define the respective relatively short strap portions 61 and 62 that are adjacent to but spaced rearwardly from the forward edging 56 in spaced apart congruent relation, and the respective relatively long strap portions 63 and 64 that are at the lug rear edging 58, which also are in spaced apart, congruent relation. The strap portions 61 and 62 are formed to define aligned apertures 65 and 66, respectively, and strap portions 63 and 64 are formed to define aligned apertures 67 and 68, respectively, to respectively receive the fasteners employed to fix the respective lugs 44 and 46 to the brake beam main beam 32 following conventional practices.

The guide lugs 44 and 46 in practice are generally flat or planar in block diagram configuration, and their strap portion 63 and 64 in some embodiments have a second set of apertures aligned with the apertures of the strap portions 61 and 62 for additional securement of the respective lugs to the main beam 32. In any event, it is conventional practice to mount the brake beams 30, as equipped with such guide lugs 44 and 46, in their opposed relations (diagrammatically illustrated in FIG. 1) by slidably mounting guide lugs 44 and 46 thereof in between opposed pairs of the conventional guide brackets 70 that are located at the in-board side of the respective truck side frames 16. As indicated in FIGS. 1–4, the guide brackets 70 conventionally are an integral part of the side frame and comprise an upper wall or ledge 72 that is spaced above and parallels the lower ledge or wall 74, which walls 72 and 74 project from the side frame basic wall structure 77 that in the area of brackets 70 is shaped as diagrammatically indicated in FIGS. 2–7. The ledges or walls 72 and 74 are spaced apart by floor or basic wall 75, and these walls define as part of the side frame wall structure 77 a planar slot 78 that is open as to 80 to receive the aforementioned conventional spring steel wear plate 82. The walls or ledges 72 and 74 each define confronting inner surfaces 81 and 83 that with floor 75 form slot 78.

Wear plate 82 is of U-shaped transverse cross-sectional configuration, it being formed from spring steel sheet material of 3/16 inch thickness by a suitable processing to define web portion 84 and spaced apart upstanding side walls 86 and 88 surmounted, respectively, by the respective laterally extending edges 90 that lie against guide bracket wall planar end surfaces 92 and 94 when the wear plate 82 is in its operating position (only fragments of ledges 90 are shown in FIG. 2). The wear plate side walls 86 and 88 conventionally are each formed to define at their outer surfaces 87 and 81 a pair of outwardly extending protuberances 96 (only one is shown in FIG. 3) that are intended to lodge in conventional pairs of securement apertures 98 that are formed in the respective walls 72 and 74, as suggested by the showing of FIG. 3. The wear plate walls 86 and 88 have a free standing relation to diverge outwardly of the wear plate web portion 84 at a suitable flat angle so that when the wear plate is force fitted into the slot 78, its side walls 86 and 88 will be bent towards each other to dispose them, and specifically, their inner surfaces 89 and 93, in substantial parallelism, as indicated by the diagrammatic showings of FIGS. 1–3.

The guide bracket walls 72 and 74 at the upper ends of same are formed to define concavely arced corners 100 from which they extend upwardly to integrally unite with the short end wall 102 that forms the upper end of the slots 78. The conventional wear plate side walls 86 and 88 are similarly shaped to conform to the concave corners 100, as at 104 (see FIG. 2).

As indicated by the larger scale showing of FIG. 2, conventional practice is that the side walls 86 and 88 of the conventional wear plate 82, when the latter is mounted in its operating position, are spaced apart a distance that, because of the sliding, metal to metal relationships involved, has to exceed the thickness of the unit brake beam guide lugs 44 and 46 that are to be slidably mounted within the slots 78 and between the side walls 86 and 88 of the wear plate 82. The arrangement of the brake beams and the parts they carry is such that the beams are eccentrically weighted whereby any looseness of the fit of the brake beam guide lugs within the guide brackets 70 results in the brake beams tending to sag downwardly at their upper ends, with the brake beam guide lugs thus becoming angled or cocked with respect to the slots 78, and the upper ends of the brake shoes being disposed too close to the wheel treads they are to engage, such that in extreme cases, in the retracted position of the brake beams, the shoes will drag at their upper ends on the wheel treads involved. It is apparent that on actuation of the brake equipment with the brake beams so angled, the brake beam brake shoes will not be applied flush against the steel treads. The guide brackets 70 are conventionally formed to lie on a radius of the axle wheel that the brake beam as mounted thereon is to serve, which is one of the indicated angulations to the horizontal that had been mentioned, Hangerless unit brake beams are conventionally designed so that when they, and especially their guide lugs 44 and 46, are coplanar with the plane in this radius longitudinally of the axle to be services by the brake beam, as indicated by the block diagram type showing of FIG. 1, the brake shoes 42 will be applied flush against the wheel treads when the braking forces are applied.

However, standard practices require the loose or sloppy fit of the brake beam guide lugs 44 and 46 within the wear plates 82 because both the wear plates 82 and the guide lugs 44 and 46 are subject to corrosion and must be proportioned to have the loose fit that is indicated in FIG. 2, which is needed to insure some sort of freedom of movement to permit the brake applying action that is desired in accordance with standard practices. This looseness of fit and the brake sag that results from same worsens as the parts involved wear in service, due to the metal to metal sliding action that is involved. Furthermore, the slots 78 tend to fill up with debris, moisture, and in winter, ice and snow, which tends to clog the freedom of movement of the brake beam guide lugs 44 and 46, occasionally resulting in jamming of the components involved and other problems resulting in loss of brake pressure.

In the showing of FIGS. 1 and 2, lugs 44 and 46 are indicated in block diagram form only, with the specifics of one of the conventional guide lug types to which the invention of this application is applicable being shown in FIGS. 3–8.

In the specific type of conventional brake beam guide lugs 44 and 46 that is illustrated in the drawing FIGS. 3–8, the guide lug body lower side wall 54 is intended to be slidably supported on the wear plate side wall 88, and the upper guide lug side wall 52 is intended to be free of compressive loadings, even though in practice the positional relationships illustrated in FIG. 2 take place in the mounting of the unit brake beam guide lugs 44 and 46 within the side frame guide brackets 70.

Conventionally, side walls 72 and 74 of brackets 70 are formed to be apart a nominal two inches with a tolerance range of plus 3/32 inch and minus zero inch (the distance between their surfaces 81 and 83). Guide lugs 44 and 46 are conventionally made to have a nominal length of 4.5 inches between their side edgings 56 and 58, and to have a breadth or depth (the dimension separating their respective side wall surfacings 52 and 54) that is 1.5 inches with a tolerance range of plus zero and minus 1/16 inch (or 1 and 7/16ths (1.4375) inches (AAR standard S-345-79). Wear plates 82 are formed so that when they are force fitted into a slot 78, their side wall inner surfaces 89 and 93 will be in substantial parallelism and spaced apart a nominal one and $\frac{5}{8}$ (1.625) inches. The guide lugs 44 and 46 are conventionally applied to unit brake beams and mounted in wear plates 82 are disposed in the wear plates 82 so that their web portions 51 are spaced from the wear plate web portion 84 approximately $\frac{3}{8}$ of an inch.

Referring now more specifically to FIGS. 4–7, in accordance with the present invention, the unit brake beam guide lugs 44 and 46, in the form illustrated in FIG. 3, are each equipped with a slide bearing 130 of special construction that is provided for slidably mounting the unit brake beam guide lugs 44 and 46 in guide brackets 70, and specifically within the slots 78 they define, without the side frame guide brackets 70 or the unit brake beams 30 having to be modified in any way. In the embodiment of FIGS. 4–7, and 9, the slide bearings 130 replace the troublesome wear plates 82, while in the variant form of FIG. 8, the slide bearing 130A there illustrated and the associated guide lugs 44 and 46 (represented in FIG. 8 by guide lug 44A) are proportioned for slidably mounting the unit brake beam 30 involved in the conventional wear plates 82; in the embodiment of FIGS. 10 and 11, the slide bearings 130B are similar to slide bearings 130, and also replace wear plates 82.

Referring first to the specifics of the slide bearing 130, it comprises flat, box like body 132, that is of one piece construction and preferably is formed from polymeric material that in the preferred form is ultra high molecular weight polyethylene having a molecular weight in the range of from about three million to about nine million.

The slide bearing body 132 is formed to define central web portion 133, and upstanding side walls 134 and 136 that are in parallel spaced apart relation along either side edge of the web portion 133. Closing off the body 132 at either end of same are the respective integral end walls 131 and 135.

In accordance with the invention, the body web portion 133 and the upstanding side walls 134 and 136 and end walls 131 and 135 are shaped and proportioned for complementary fit, reciprocatory seating relation, within the guide slots 78 of the respective guide brackets 70, whereby the external surfacing 137 of the body 132 is in substantial complementary, but free sliding relation, with the internal surfacing 139 of the respective guide brackets 70. In practice, the proportioning of the body 132, and specifically its outside upper and lower surfaces 137A and 137B, of its external surfacing 137, relative to bracket internal surfaces 81 and 83 of surfacing 139, are such that the body 132 fits in the 2 inch slot 78 with an approximate 1/32 inch tolerance, and body 132 fits in the 2-3/32 slot 78 with an approximate $\frac{1}{8}$ inch tolerance, with respect to the corresponding portions of bracket internal surfacing 139 of such slots. The body web external base surface portion 137C (of its surfacing 137) normally may be spaced from slot floor 75 somewhat due to the normal spacing of the guide lug side edgings 60 from the slot floor 75 in service use of same. The body external side surfaces 137A and 137B are essentially planar in configuration and smooth in the sense of being free of surface roughness, porosity, scaling, pitting, or the like; they are also uncoated to fully expose the polymeric material involved, and be in the antifriction, slip fit, relation with the bracket surfaces 81 and 83 that is contemplated by the present invention. The body base surface 137C is similar in character to surfaces 137A and 137B; surface 137C merges into the respective surfaces 137A and 137B at the external rounded corners shown in FIG. 7 that are preferably struck on a $\frac{1}{4}$ inch radius for easy fitting into the smaller 2 inch wide slots 78. Surfaces 137A and 137B are also essentially in parallel relation and their planes are essentially normal to the plane of base surface 137C.

The side walls 134 and 136 of body 132 are spaced apart to define the respective wall inside surfacings 138 and 140 that are spaced apart to receive as closely as practical the respective guide lug upper and lower side walls 52 and 54 of the AAR standard 1.5 inch thickness in substantial complementary relation to same, while the end walls 131 and 135 define inside surfacings 141 and 143 that closely receive the guide lug side edgings 56 and 58, in substantially complementary relation thereto, with these parts being shaped and proportioned such that when body 132 is applied to the respective guide lugs 44 and 46 (having the specifics shown in FIGS. 3–7), the lugs 44 and 46 are squarely received in the respective bodies 132 with a light forced fit, such that, by tapping body 132 onto the guide lug in question by hammer action applied to its web portion 133, the guide lug as fully received in body 132 is squarely mounted relative to the body 132 (as indicated in FIGS. 5, 6 and 7), and is held in substantially fixed relation thereto, and in the coplanar relation indicated in the drawings.

The bearing body side walls 134 and 136 are each recessed as at 144 in aligned relation transversely of the body 132 to define a pair of oppositely disposed circular recesses 146 and 148 (see FIG. 9) each having an annular outer flat or planar land portion 150 that is in circumambient relation about a frusto-conical land portion 152 that in turn is in circumambient relation about a central aperture or opening 154. Seated in the respective recesses 146 and 148 in substantial complementary relation thereto are the respective truncated metal washers 156 and 158, each of which comprises a planar annular rim portion 160 that is in circumambient relation about frusto-conical portion 162 that in turn is in circumambient relation about central planar disc portion 164. The washer portions 160, 162, 164 are in substantial complementary relation to the body recess portions 150 and 152 and aperture 154, so that when the respective washers 156 and 158 are fitted into the respective recesses 146 and 148 in the manner indicated in FIGS. 6, 7 and 9 of a bearing body 132 that has been applied to a guide lug 44, 46 in the manner indicated, the washer portions 164 will engage or be in closely spaced relation with the guide lug respective side walls 52 and 54, for affixing thereto, respectively, as by welding. Washers 156 and 158 are identical, and are commercially known as weld washers and are made by employing suitable stamping procedures; they are available from a number of sources, such as Certified Welding and Manufacturing Co. of Aurora, Ill., and Joliet Wrought Washer Co., Joliet, Ill. Recesses 146 and 148 are formed to have a depth that exceeds the thickness of the washer land portions such that the washer land portions are recessed below the respective bearing surfaces 137A and 137B a suitable amount, such as 3/32 inch, to avoid metal to metal contact of the weld washers and guide bracket walls 72 and 74 in service. Where these washers are of the type in which the disc portion 164 is imperforate, projection welding is employed for this purpose, while if the disc portion defines an aperture, plug welding is employed for this purpose, as will be apparent to those skilled in the art.

Thus, the slide bearings 130 define a box like body 132 that is open as at 165 to receive the guide lug on which same is to be mounted, as indicated by FIGS. 4–7, the body 132 is generally of a rectilinear outline, and of channel shaped configuration in transverse cross section. Body 132 thus has an open end 167 and a closed end 169 at its web portion 133.

In applying a slide bearing 130 to a unit brake beam 30 in accordance with the embodiment of the invention shown in FIGS. 4–7, and assuming that the brake beam 30 in question has its guide lugs 44 and 46 (of the type shown in FIGS. 3–7) suitably secured thereto, the individual bearing bodies 132 are first applied to a selected unit brake beam 30 by, in the case of each guide lug 44 and 46, orienting and aligning the bearing 130 with respect to same so that the bearing body open end 165 faces or opposes the web portion 51 of the guide lug, and then passing the bearing body onto the guide lug to the position of FIGS. 5–7, within tapping of the bearing body 132 at its closed end 169 being effected by a hammer or the like as needed to complete this assembly. Washers 156 and 158 are then applied to their respective recesses 146 and 148 in the manner indicated in FIGS. 6 and 7, and their disc portions 164 suitably affixed to the lug side walls 52 and 54, respectively, as by employing one of the welding techniques indicated or any other suitable welding or other bonding technique.

The unit brake beam so equipped with the slide bearings 130 at either end of same then may be applied to the respective guide brackets 70, leaving off entirely the spring steel liners 82, which are replaced by the bearings 130.

The brake beam guide lugs 44 and 46 of a brake beam 30 so equipped are inserted one at a time from the end wall 102 end of the brackets 70, with one guide lug mounted bearing body 132 being inserted into a guide bracket slot 78 of one of the guide brackets 70 to mount same, and then the brake beam other guide lug mounted bearing body 132 is similarly applied to the opposing guide bracket slot 78. When both unit brake beams have their guide lugs 44 and 46 mounted in the bracket slots 78 in the manner indicated in FIGS. 5–7, the unit brake beams 30 may be connected in any suitable manner to complete the assembly of the brake equipment in accordance with standard technology and known how on this subject, which of course may be either of the truck mounted tyoe, or car body mounted type.

Where new brake equipment is involved, the bearings 130 are applied, in the manner indicated, to the truck brackets 70 involved, at the appropriate stage in the assembly of the brake equipment.

Thus, the unit brake beam guide lugs 44 and 46 are shiftably mounted within the respective truck guide brackets 70, in accordance with the invention, by the bearings 130 mounted thereon respectively being inserted in the respective slots 78 that are defined by the bracket side walls 72 and 74; the bearings 130 are in substantially complementary, close fitting, face to face, sliding contact and load bearing relation with and between the guide bracket side walls 72 and 74, and specifically, the bearing body respective smooth, planar, antifriction, wear resistant, and corrosion free external surfaces 137A and 137B, are in such contact and load bearing relation with guide bracket surfaces 81 and 83, as indicated in FIGS. 5 and 7. FIGS. 5–7, and 9 illustrate the manner in which the guide bodies 130 of all the unit brake beams 30 for a particular truck arrangement 10 are mounted for operation within the conventional guide brackets 70, and specifically within the slots 78, thereof, in replacement of the troublesome wear plate 82.

Figure 9:
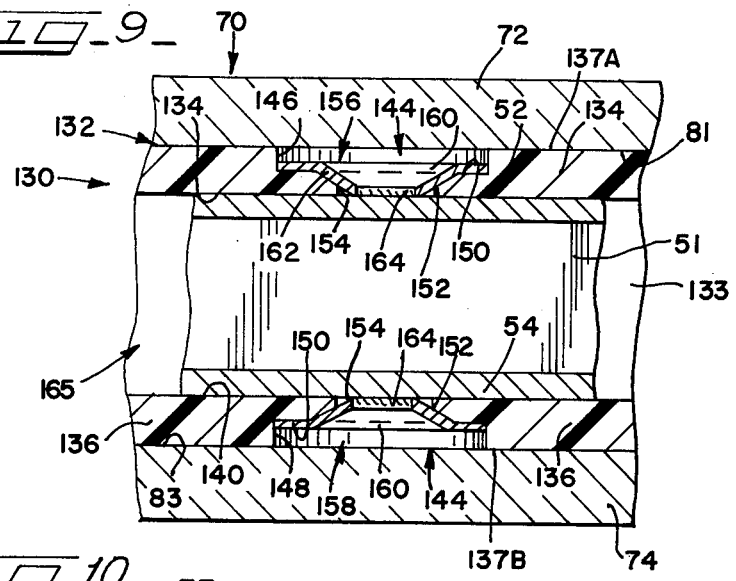
FIG. 9 is a fragmental view similar to that of FIG. 6, but on an enlarged scale for better illustrating the slide bearing connections to the brake beam guide lugs.

In connection with the mounting of the bearings 130 within the guide bracket slots 78, the guide bearing body 132 and its side walls 134 and 136 are proportioned to provide as mounted in a particular guide bracket 70, the indicated clearance or tolerance between the respective surfacings 81 and 83, which is as close as practical to the slot width of brackets 70 having their slots 78 lying in the AAR standard width range of from 2.000 inches to 2&3/32 (2.09375) inches, to achieve the substantially complementary but freely sliding, slip fit, substantially face to face sliding load bearing contact relation, of the body 130 within the bracket slot 78 that is contemplated by the present invention, and as illustrated in FIGS. 6, 7 and 9, having in mind the need to accommodate the usual tolerance variations in this field. Bearing in mind the conventional AAR prescribed spacing between guide bracket side wall surfaces 81 and 83 of 2.0000-2 and 2/32 (2.09375) inches, the bearing body 132, between its external side surfaces 137A and 137B, and as mounted on the respective guide lugs 44 and 46, should have a width or depth dimension between such surfaces 137A and 137B that ranges between 1.96875 (1-31/32) inch and 1.9375 (1 and 15/16) inch, for a clearance between the guide bracket wall surfaces 81 and 83 that ranges between the indicated 1/32 (0.03125) inch and the indicated ⅛ (1.125) inch, to hold the relationship of parts shown in FIGS. 6, 7 and 9. The inside surfacings 138 and 140 of the body 132 are spaced apart relative to the guide lugs 44 and 46 (having the indicated AAR standard thickness) to closely receive such guide lugs therebetween with at least a proportionately similar tolerance range and preferably a tight, motion free, fit with the guide lug and bearing body 132 in squared, coplanar relation. The brake beam guide lugs 44 and 46 as received in a specific bracket slot 78 to mount a unit brake beam 30 in accordance with the invention should dispose the bearing body edge surfacing 137C from the guide bracket floor 75 a dimension in the range of from about 9/32 inch to about 0.5 inch at each lug edge 60 of a particular brake beam involved, when the brake components are at rest in their normal positions; but in service, unit brake beams tent to shift somewhat from side to side so the bearing surfacing 137C will occasionally also be in the indicated slip fit, antifriction sliding relation to the guide lug 44 or 46 the body 132 in question mounts.

Thus, the complemental fit of the bearing body 132 within the guide bracket slots 78 contemplated by this invention, invention, which, together with the fit of the respective guide lugs 44 and 46 within the respective bodies 132, maintains the brake shoes for flush application to the wheel treads they service, involves the body 132 fitting in the slot 78 with a clearance in the range of from 1/32 (0.03125) inch to ⅛ (0.125) inch. This complemental fit insures ready application of the body 132 to the slots 78, with the body 132 (assuming again the AAR standard brackets 70), drooping or angling in the slots 78 under the eccentric loads on the brake beam at an angle approximately zero degrees and fifteen minutes for bearing 130 as applied to the 2 inch wide slot 78. Application of the bearing bodies 132 to the 2-3/32 inch wide slot 78 will result in an angle of droop approximately one degree. The fit of the guide lugs 44 and 46 within the bearing bodies 132 should be with at least proportionately similar tolerances, so that the angle of inclination or droop of the brake beam 30 from coplanar positioning relative to the plane of the slots 78 mounting same is no more than about two degrees even for the 2-3/32 inch slots 78. As indicated, it is preferred that the bearing bodies 132 as applied to lugs 44 or 46 will be in squared relation thereto, so that it is the fit of the bodies 132 in the slots 78 that controls the indicated angle of "droop".

Where the guide lugs 44 and 46 are over the AAR standard size in thickness, they should be ground to that standard size thickness for application to a bearing 130, as indicated by the AAR measuring gauge for such lugs (AAR standard S-360-79) that is commonly used for checking out guide lug dimensioning relative to the indicated AAR size standard for insuring compliance. Where the guide lug is under the AAR standard size thickness, it should be rejected.

Under gravity the bearing bodies 132 rest on the bearing bracket side wall 72 or 74 that is disposed on the underside of the bearing 130 as mounted in its operating position in a particular truck guide bracket 70, with the bearing upper facing or side 81 bearing against the bracket side wall 72 or 74 that is disposed at the upper side of the bearing 130 as mounted, due to the eccentric loadings on the unit brake beams that the respective lugs 44 and 46 support. For guide bearings 130 on the side of the bolster illustrated in FIGS. 5–7, the bearing body side wall 136 is at the lower side of the bearing, and for bearings 130 mounted on the other side of the bolster, the bearing body side wall 134 is on the underside of the bearing. In any event, the guide lugs 44 and 46 of a particular unit brake beam, whether at rest or in motion, are held in essentially substantially coplanar relation with the plane of the axle radius along which the guide bracket slots 78, and thus the bearing bodies 132, lie, and thus the unit brake beam brake shoes, for instance brake shoes 42, are held for application to the respective wheel treads 56, in accordance with the practice of the invention, in approximately the indicated flush application, by way of the complemental fit of the bearing bodies 130 within bracket slots 78 that is contemplated by this invention.

Thus, with the proportioning of parts of the slide bearing 130 relative to the internal configuration of the guide bracket slots 78 being in the complementary but sliding fit proportioning indicated, and the fit of the guide lugs 44 and 46 within bearings 130 being in the corresponding proportion indicated, the unit brake beams 30 will then be mounted in their respective guide brackets 70 approximately with the correct brake shoe flush fit application relationship indicated in FIG. 1, rather than the sloppy fit relation indicated in FIG. 2 that has been so much of a problem in accordance with prior art practices.

In the embodiment of FIG. 8, the slide bearing 130A and the guide lugs of the brake beam, one of which is shown at 44A, are proportioned to be both received within the conventional spring steel wear plate 82 as the latter is normally mounted within the guide bracket 70, for each of the truck side frames in question, with the bearing body 132 being proportioned relative to the internal surfacing 139A of wear plate 82 to have its external surfacing 137 in the substantially complementing, face to face, but free sliding relation to the surfacing 139A, when the wear plate 82 is conventionally mounted in its guide bracket 70, that is contemplated by this invention. Other structural features of the guide lug 44A and side bearing 130A and its body 132A are the same, as indicated by corresponding reference numerals.

In the slide bearing 130B (see FIGS. 10 and 11), the common Norway bolt type fastener 170 is employed instead of weld washers 156 and 158, with slide bearing 130B being of the type represented by bearing 130, in that this slide bearing also replaces the troublesome steel wear plate 82.

Fastener 170 comprises bolt 172 having frustoconical head 174 and threaded shank 176 that threadedly receives nut 178. To receive bolt shank 176, the guide lug side walls 52 and 54 are suitably apertured as at 180. The bearing body 132B is formed in its side wall 134 to define circular recess 182 having frusto-conical land portion 184 that is in circumambient relation about central aperture or opening 186 which is aligned with corresponding opening 188 of bearing side wall 136, which is also formed to define recess 190 that defines planar land 192 that is in circumambient relation about the opening 188.

In this embodiment of the invention, after the guide lug 44 or 46 has a slide bearing body 132B applied thereto in the manner already indicated, with the slide bearing and guide lug apertures aligned, the bolt fastener is applied thereto in the manner indicated in FIG. 11, with bolt head 174 seated in recess 182 against land 184, and nut 178 threaded on shank 176 against land 192, to hold these components together without requiring bonding techniques. The recesses 182 and 190 are made of sufficient depth to recess the bolt fastener head and nut below bearing body surfaces 137A and 137B free of metal to metal contact with walls 72 and 74 of the guide brackets 70 in service (such as the aforementioned 3/32 inch). The bearing body recess 182 and its opening 186, and recess 190 and its opening 188 may be respectively formed in the bearing body walls 136 and 134, respectively, as desired, of course. Bearings 130B are otherwise the same as bearings 130, as indicated by corresponding reference numerals.

Norway bolts are commonly available hardware, one source of same being McMaster-Carr Supply Co. of Elmhurst, Ill. The Norway bolt fastener approach may also be applied to the embodiment of FIG. 8, as will be apparent to those skilled in the art.

The ultra high molecular weight polyethylene indicated is available from several sources; one source is the molecularly oriented UHMW polyethylene marketed by Keltrol Enterprises of York, Pa. under the trademark TUFLAR (Grade P.), while another is the high I.V. (intrinsic viscosity) UHMW polyethylene marketed by Industries PPD Inc. of Sherbrooke, Quebec, Canada.

The ultra high molecular weight polyethylene material of the type indicated is a high density polymer of dry self lubricating characteristics that is sufficiently compaction resistant to resist any substantial compaction under compressive forces up to its elastic limit, and has a high degree of elastic memory for full return to original free standing shape after being stressed, up to its elastic limit. This material also has a high degree of toughness and long wearing characteristics, and is also receptive to fillers in the form of glass, clay, sand, suitable fabrics, and alumina, for modifying same to adapt the slide bearing body for special conditions.

The polyethylene material from which the slide bearing bodies of this invention are preferably made is also resiliently flexible, but non-stretchable, and is thus free from distending or stretching characteristics. The material indicated also has a coefficient of sliding or dynamic friction with respect to steel of about 0.15, whereby when the slide bearings disclosed herein are operatively mounted within guide brackets 70, the brake beams 30 are not only held during their power and retraction strokes in close proximity to the right relationships to bring the brake beam shoes into flush or substantially frictional relation with the axle wheels they are to service, but the brake beams are in free sliding relation with respect to the truck frame guide brackets 70 that operatively mount same, and they are mounted in an essentially wear free manner.

Alternately, the slide bearing bodies may be formed from nylon or Nylatron, the latter being a molybdenum disulphide filled nylon product made and sold by The Polymer Corporation of Reading, Pa. Polyurethane, Delrin, high molecular weight polyethylene, or General Electric Company's polycarbonate product sold under the trademark LEXAN, may also be employed to make the body forming the slide bearing in question. The non-UHMW plastic materials suggested are available from Evans Tool and Manufacturing, Inc., of Aurora, Ill. However, the ultra high molecular weight polyethylene material having the characteristics indicated is preferred because of its particular suitability for the purposes of the present invention.

It will thus be seen that in trucks 10 that have their guide brackets 70 equipped with the slide bearings 130 or 130A or 130B on each side of the truck bolster, the unit brake beam 30 or its equivalent, with which the truck 10 is equipped, as hereindisclosed, and specifically the guide lugs 44 and 46 of same, will be disposed and guided in substantial alignment with the plane of the axle radius on which the pair of opposed guide brackets 70 for the specific unit brake beam involved lie. The unit brake beams 30 or their equivalent will thus be held in close proximity to the theoretically desirable position diagrammatically illustrated in FIG. 1 in which the wear surfaces 45 of the brake shoes 42 will be presented flush against the wheel treads they are to be applied against; in other words, the upper and lower portions of the brake shoe wear surfaces 45 involved will be applied substantially simultaneously against the wheel treads being braked on application of the braking pressure.

Furthermore, the action of the brake beam guide lugs 44 and 46 in moving toward and away from the braking position along the slots 78 defined by the respective guide brackets 70 is truly free and easy in view of the antifriction characteristics provided by the slide bearing external surfacing 137, with the brake beam guide lugs 44 and 46 being held substantially in coplanar relation with or in close proximity thereto, the indicated radial plane of operation of the brake beams, respectively, along the indicated radius of the respective axles being braked, and for a useful life that can reasonably be expected to outlast the truck bolster and side frames.

In use, as the guide lugs 44 and 46 with the slide bearings 130 or 130B mounted on same, respectively, are repeatedly moved with respect to the guide brackets 70 in the case of the embodiments of FIGS. 4–7, and 9–11, the external surfacing 137 of the slide bearings 130 effects a polishing or honing resurfacing action on the corresponding surfacing 139 of the guide brackets 70, engaged thereby, such that after a period of normal use, the upper, lower, and side surfacings 81, 83 and 75 of the guide brackets in question, instead of being worn, tend to be resurfaced so as to be effectively resistant against further wear, further reducing the coefficient of friction between the slide bearings carried by the respective guide lugs and the corresponding walls of the guide brackets 70 in question. The same effect occurs in connection with the embodiment of FIG. 8 with regard to the corresponding surfaces of the steel wear plate side walls 86 and 88 at its web 84. What appears to happen is that as the slide bearings involved move longitudinally of the slideways defined by the guide brackets 70, the polymer material that the bearing external surfacing 137 tends to fill up the pores and level the irregularities in the metal surfacing forming the guide brackets 70, and in the case of the embodiment of FIG. 8, the spring steel wear plate 82, such that such surfaces become partially reformed and defined by the transferred polymer material from the slide bearing external surfacings involved.

Foreign matter that is caught between the slide bearings and the metallic surfaces the slide bearing external surfacing 137 cooperates with becomes embedded in the slide bearing, and thus is positioned to avoid wearing engagement with the metallic surfaces the slide bearings cooperate with. Further, as such foreign matter becomes embedded in the bearing, the thickness of its walls and web tend to correspondingly enlarge, thus providing a self compensating effect making up for such wear or attrition on the bearing surfacing as may be due to the aforementioned resurfacing action.

The slide bearings involved being formed from the indicated dry self lubricating material, the need for applying separate lubricating materials in this area is avoided, thereby permitting the truck guide brackets and associated parts to be free of wet type lubricants that would otherwise be employed for this purpose, which commonly accumulate foreign matter that aggravates wear problems. The preferred polymeric material employed in the practice of the invention also resists adherence thereto of foreign matter which thus will not accumulate where it could adversely affect the free and easy sliding action longitudinally of the guide brackets that is provided by the slide bearings of the present invention. It has also been found that the bearing external surfacing 137 tends to harden in use, thus increasing the ability of this surface to resist wear and this is also true of the polymeric material that is transferred to the guide bracket wall surfacings, or the corresponding wall surfacings of the spring steel wear liner 82, as the case may be.

The result is that wear at the guide lugs 44 and 46, slide bearings 130, 130A, and 130B, and the corresponding surfacings of the guide brackets or steel liners that they cooperate with is eliminated, whereby an essentially wear free mounting of the unit brake beams in the truck guide brackets is provided in which the aforementioned critical clearance range is maintained for the useful life of the guide lug slide mounting provided, which can reasonably be expected to exceed the useful life of the truck bolster and side frames.

The upper and lower portions of the external surfacing 137 of the slide bearings hereindisclosed, when such bearings are in their operating positions, serve as cam followers acting in a rectilinear manner following the cam surfacings defined by the walls 72 and 74 of guide brackets 70, and in the case of the embodiment of FIG. 8, the corresponding walls 86 and 88 of the spring steel wear plate 82.

The smooth shifting action provided by the application of the invention to unit brake beams and guide brackets therefor of the type indicated permits maximum application of the braking energy involved in a braking operation to the truck wheel treads, as distinguished from the substantial losses of same that heretofore have been needed to overcome the highly frictional engagement of the brake beam guide lugs or extensions with the conventional spring steel wear plate 82. Full retraction of the brake beams under gravity, vibration, and train movement is made a probability due to the free and easy sliding action provided by the slide bearings 130, 130A and 130B of this invention.

The near optimum or proximate holding action of the individual brake beams and their shoes relative to the wheel treads they cooperate with, when the brakes are applied, avoids uneven wear of the brake shoes and precludes wear at the brake heads that in the past has occurred under extreme conditions when the brake beams are mounted in the manner indicated in FIG. 2.

The tendency of snow or ice to pack in the area of the guide brackets 70 is substantially reduced or eliminated due to the non-porous nature of the polymeric material forming the slide bearings involved and its resistance to adherence thereto of foreign materials, as well as the resurfacing action provided thereby on the metallic surfaces of the guide brackets involved, or in the case of the embodiment of FIG. 8, the spring steel liner involved, which resurfacing provides similar benefits to the resurfaced surfaces. Heretofore the compacting of snow and ice in the space defined by the prior art spring steel wear plate 82 has been a common cause of jamming of the brake beams in their guide brckets and loss of brake pressure.

The time for full brake application and full release of the brakes, of the brake equipment equipped with the guide bearings 130, 130A and 130B of this invention, is substantially reduced due to the free and easy sliding movement that the brake beam guide lugs have within their mounting slotways defined by the guide brackets involved, which become permanently lubricated by the resurfacing action involved and require no further attention even though no conventional liquid type lubricant is involved.

The application of the invention to brake rigging of caboose cars has an especially significant advantage as the slide bearings of this invention act as sound deadeners, as distinguished from the rather noisy action of the metallic unit brake beam guide lugs operating within the conventional spring steel wear plates 82, applied as indicated in FIG. 2, and thus without the benefit of the slide bearings of the present invention. Further, applying the guide lugs 44 and 46 to bearings 130, 130A and 130B protects the edges of the guide lugs from damage, as if the guide lugs are accidentally thrust against, for instance, the bracket flanges 72 or 74, metal to metal contact is avoided for lugs 44 and 46 to which one of the indicated bearings are applied, which avoids chipping or fracturing of the guide lugs.

The slide bearing 130C (see FIGS. 12 and 13) is similar to slide bearing 130, but has its body 132C received on guide lug 44B that is of the solid construction type (as indicated in FIG. 13 for body 50C), that illustrated being intended to represent the guide lugs employed on Davis one piece head unit brake beams offered by Davis Brake Beam Company of Johnstown, Pa. (see page 613 of the 1980 edition of the Car and Locomotive Cyclopedia). In this embodiment, body 132C is the same as body 132, but is proportioned for light force fitting on the guide lug 44B and the similarly contoured guide lug at the other end of the brake beam in a manner similar to body 132, with the lug 44B being drilled or otherwise suitably formed with cross opening 200 to receive Norway bolt fastener 170.

The slide bearing 130D (see FIGS. 14 and 15) is also similar to slide bearing 130, but has its body 132D received in guide lug 44C that is also of the solid construction type, but is formed in its upper surface 53 to define centrally located recess 210 (as indicated in FIG. 14 for body 50D), that illustrated being intended to represent the guide lugs employed on Creco hangerless brake beam offered Creco Division of Evans Products Company (see pages 620 and 621 of the said 1980 edition of the Car and Locomotive Cyclopedia). In this embodiment, the body 132D is the same as body 132, but is proportioned for light force fitting on the guide lug 44C (and the similarly contoured guide lug at the other end of the brake beam) in a manner similar to body 132, with the lug body 50D being drilled or otherwise suitable formed with cross opening 212 to receive Norway bolt fastener 170. In this embodiment metallic bracing washer 214 or its equivalent is preferably employed between the bearing body wall 134 and lug body 50D within recess 210 and about bolt fastener shank 176.

The slide bearings 130C and 130D provide the same action and advantages as described for bearing 130.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a railroad car truck including spaced side frames riding on a pair of first and second wheeled truck axles, a bolster intermediate said axles and resiliently supported at either end of same from the respective side frames by a spring group interposed between the spring seats of the respective bolster ends and the side frames supporting same, first and second unit brake beams disposed one on either side of the bolster, with the first brake beam having brake heads adjacent each end of same each equipped with a brake shoe for braking application to the wheels of the first truck axle, and with the second brake beam having brake heads adjacent each end of same each equipped with a brake shoe for braking application to the wheels of the second truck axle, said brake beams each having guide lugs at their respective ends, with the side frames on their in board sides defining for the first brake beam a first pair of opposed guide brackets each defining a guide slot lying on a radius of the first truck axle in which said first brake beam guide lugs are respectively mounted for movement along said first truck axle radius in a plane that includes said first brake beam guide slots, and with the side frames on the in board sides defining for the second brake beam a pair of opposed guide brackets each defining a guide slot lying on a radius of the second truck axle in which said second brake beam guide lugs are respectively mounted for movement along said second truck axle in a plane that includes said second brake beam guide slots, said guide lugs each being of U-shaped section defining a web portion that faces the respective side frames and upper and lower side flanges projecting from said web portion for connection to the brake beam main beam, and power means for moving the respective brake beams along the respective slots to seat the respective brake shoes against the respective truck wheels to apply the truck brakes, the improvement wherein:

a bearing structure is mounted on each of said brake beam guide lugs for slidably mounting same in the respective side frame guide brackets, said bearing structures each comprising:

a box-like body formed from a polymer material of dry self lubricating characteristics, said body being planar and rectilinear in outline and of U-shaped transverse cross section configuration along the length thereof defining a web portion and spaced apart parallel side walls projecting from said web portion in superposed relation, said body side walls being spaced apart to closely receive the guide lug mounted therein, with said body side walls being joined together at either ends of same by opposed integral end walls that form the forward and rearward ends of the respective bearing structures, said body receiving the guide lug it is mounted on between said side walls thereof with one side wall on the upper side of the guide lug and the body other side wall at the lower side of the guide lug, said body side walls each recess mounting means for securing said bodies to the respective guide lug flanges, said bodies being respectively slidably received within the respective side frame guide slots to mount said brake beams, respectively, for said movement of same along the respective guide slots under the action of said power means, said bodies being proportioned at the outer surfacings of said sidewalls thereof for substantially complemental fit of the respective bodies within the respective guide slots for maintaining said brake beams, respectively, in substantial coplanar relation with the axle radius of the guide bracket guide slots in which the respective brake beams are mounted, whereby on actuation of said power means the brake beam shoes are presented in flush relation with the respective truck wheels.

2. The improvement set forth in claim 1 wherein:

said outer surfacings of said side walls of said bodies have a coefficient of friction of about 0.15 with respect to steel, and said outer surfacings riding directly on said guide brackets, respectively, of the respective guide brackets.

3. The improvement set forth in claim 1 wherein:

said outer surfacings of said side walls of said bodies have a coefficient of friction of about 0.15 with respect to steel, said guide brackets of each pair of guide brackets each bearing a spring steel U-shaped wear plate, with said surfacings riding within the respective wear plates.

4. The improvement set forth in claim 1 wherein said means for securing said bodies to the respective guide lug flanges comprises:

a metallic washer mounted in the respective bodies side walls, with said washers being in opposed relation, for each of said bodies, means for fixing the respective washers to the respective lug flanges for securing said bodies to the respective guide lug flange, said washers each comprising an outer annular portion and a central plate portion displaced laterally of said annular portion, said body side walls each being counterbored in aligned relation for receiving the respective washer annular portions, said body side walls within the respective counterbores thereof being apertured to respectively receive the central plate portions of said washers for close fitting relation to the respective lug flanges of the lug received in said bearing body.

5. The improvement set forth in claim 4 wherein:

said washer central portions are bonded to the respective lug flanges to comprise said fixing means.

6. The improvement set forth in claim 1 wherein:

said bodies are formed from polyethylene and are of one piece construction.

7. The improvement set forth in claim 1 wherein said means for securing said bodies to the respective guide lug flanges comprises:

a bolt device having a bolt with a head and a shank and a nut threded on the bolt shank, with the bolt shank extending through the respective lug flanges and having its head in one of the body side wall and said nut in the other body side wall.

8. A bearing structure for application to railroad car truck side frame unit brake beam gude lugs for mounting the unit brake beam in the truck side frame guide lug guide brackets for movement toward and away from the truck axle with flush engagement of the brake beam shoes with the axle which when braking is effected, wherein the brake beam guide lugs each comprise a sheet metal member of U configuration defining a web portion and upper and lower side flanges integral with said web portion and defining straps that are apertured for connection to the brake beam main beam, with the lug web portion and side flanges defining the lug forward and rearward edgings, and the lug projecting end edging that faces oppositely of said straps, said bearing structure comprising:

a body formed from an ultra high molecular weight resiliently flexible polymer material of dry self lubricating characteristics, said body being of elongate flat box shaped configuration defining a web portion and spaced apart side walls, the inner surfacings of which define a mounting pocket for receiving the brake beam guide lug to be applied in same, with said body side walls being joined together at either end of same by opposed integral end walls that form the forward and rearward ends of the body, said web portion and said side walls being shaped and proportioned for complementing fit reciprocatory seating in the truck side frame guide bracket that are to mount the unit brake beam so as to dispose said body side walls in substantial parallelism with the respective guide brackets, with said body side walls each recess mounting means for securing said body on the guide lug.

9. The improvement set forth in claim 8 wherein said means for securing said body to the lug side flanges comprises:

a metallic washer mounted in the respective body side wall, with said washers being in opposed relation, and means for fixing the respective washers to the respective lug flanges for securing said body to the respective guide lug flanges.

10. The bearing structure set forth in claim 8 wherein:

the outer surfacings of said body side walls have a coefficient of friction of about 0.15 with respect to steel and are shaped to ride directly in the truck side frame guide bracket in place of the conventional spring steel liner.

11. The bearing structure set forth in claim 8 wherein:

the outer surfacings of said body side walls have a coefficient of friction of about 0.15 with respect to steel and are shaped to ride within a conventional spring steel liner mounted in the truck side frame guide bracket.

12. The bearing structure set forth in claim 8 wherein:

said body is formed from ultra high molecular weight polyethylene and is of one piece construction.

13. The improvement set forth in claim 8 wherein said means for securing said body on the guide lug comprises:

a bolt device having a bolt with a head and a shank and a nut threaded on the bolt shank, with the bolt shank extending through the respective lug flanges and having its head in one of the body side wall and said nut in the other body side wall.

14. In a railroad car truck including spaced side frames riding on a pair of first and second wheeled truck axles, a bolster intermediate said axles and resiliently supported at either end of same from the respective side frames by a spring group interposed between the spring seats of the respective bolster ends and the side frames supporting same, first and second unit brake beams disposed one on either side of the bolster, with the first brake beam having brake heads adjacent each end of same each equipped with a brake shoe for braking application to the wheels of the first truck axle, and with the second brake beam having brake heads adjacent each end of same each equipped with a brake shoe for braking application to the wheels of the second truck axle, said brake beams each having guide lugs at their resepective ends, with the side frames on their in board sides defining for the first brake beam a first pair of opposed guide brackets each defining a guide slot lying on a radius of the first truck axle in which said first brake beam guide lugs are respectively mounted for movement along said first truck axle radius in a plane that includes said first brake beam guide slots, and with the side frames on the in board sides defining for the second brake beam a pair of opposed guide brackets each defining a guide slot lying on a radius of the second truck axle in which said second brake beam guide lugs are respectively mounted for movement along said second truck axle in a plane that includes said second brake beam guide slots, said guide lugs each defining an edge portion that faces the respective side frames and forward and rearward side edges, and power means for moving the respective brake beams along the respective slots to seat the respective brake shoes against the respective truck wheels to apply the truck brakes, the improvement wherein:

a bearing structure is mounted on each of said brake beam guide lugs for slidably mounting same in the respective side frame guide brackets, said bearing structures each comprising:

a box-like body formed from a polymer material of dry self lubricating characteristics, said body being planar and rectilinear in outline and of U-shaped transverse cross section configuration along the length thereof defining a web portion and spaced apart parallel side walls projecting from said web portion in superposed relation, said body side walls being spaced apart to closely receive the guide lug mounted therein, with said body side walls being joined together at either ends of same by opposed integral end walls that form the forward and rearward ends of the respective bearing structures, said body receiving the guide lug it is mounted on between said side walls thereof with one side wall on the upper side of the guide lug and the body other side wall at the lower side of the guide lug, said body side walls each recess mounting means for securing said bodies to the respective guide lugs, said bodies being respectively slidably received within the respective side frame guide slots to mount said brake beams, respectively, for said movement of same along the respective guide slots under the action of said power means, said bodies being proportioned at the outer surfacings of said sidewalls thereof for substantially complemental fit of the respective bodies within the respective guide slots for maintaining said brake beams, respectively, in substantial coplanar relation with the axle radius of the guide bracket guide slots in which the respective brake beams are mounted, whereby on actuation of said power means the brake beam shoes are presented in flush relation with the respective truck wheels.

15. The improvement set forth in claim 14 wherein said means for securing said bodies to the respective guide lug flanges comprises:

a metallic washer mounted in the respective bodies side walls, with said washers being in opposed relation, for each of said bodies, means for fixing the respective washers to the respective lug flanges for securing said bodies to the respective guide lug flange, said washers each comprising an outer annular portion and a central plate portion displaced laterally of said annular portion, said body side walls each being counterbored in aligned relation for receiving the respective washer annular portions, said body side walls within the respective counterbores thereof being apertured to respectively receive the central plate portions of said washers for close fitting relation to the respective lug flanges of the lug received in said bearing body.

16. The improvement set forth in claim 14 wherein:

said bodies are formed from polyethylene and are of one piece construction.

17. The improvement set forth in claim 14 wherein said means for securing said bodies to the respective guide lug flanges comprises:

a bolt device having a bolt with a head and a shank and a nut threaded on the bolt shank, with the bolt shank extending through the respective lug flanges and having its head in one of the body side wall and said nut in the other body side wall.

18. A bearing structure for application to railroad car truck side frame unit brake beam guide lugs for mounting the unit brake beam in the truck side frame guide lug guide brackets for movement toward and away from the truck axle with flush engagement of the brake beam shoes with the axle which when braking is effected, wherein the brake beam guide lugs each define the lug forward and rearward edgings, and the lug projecting end edging, said bearing structure comprising:

a body formed from a polymeric material of dry self lubricating characteristics, said body being of elongate flat box shaped configuration defining a web portion and spaced apart side walls, the inner surfacings of which define a mounting pocket for force fit receiving the brake beam guide lug to be applied in same, with said body side walls being joined together at either end of same by opposed integral end walls that form the forward and rearward ends of the body, said web portion and said side walls being shaped and proportioned for complementing fit reciprocatory seating in the truck side frame guide bracket that are to mount the unit brake beam so as to dispose said body side walls in substantial parallelism with the respective guide brackets, with said body side walls each recess mounting means for securing said body on the guide lug.

19. The improvement set forth in claim 18 wherein said means for securing said body to the lug side flanges comprises:

a metallic washer mounted in the respective body side wall, with said washers being in opposed relation, and means for fixing the respective washers to the respective lug flanges for securing said body to the respective guide lug flanges.

20. The improvement set forth in claim 18 wherein said means for securing said body on the guide lug comprises:

a bolt device having a bolt with a head and a shank and a nut threaded on the bolt shank, with the bolt shank extending through the lug and having its head in one of the body side walls and said nut in the other body side wall.

* * * * *